United States Patent [19]

Novinski

[11] Patent Number: 4,593,007

[45] Date of Patent: Jun. 3, 1986

[54] ALUMINUM AND SILICA CLAD REFRACTORY OXIDE THERMAL SPRAY POWDER

[75] Inventor: Edward R. Novinski, East Williston, N.Y.

[73] Assignee: The Perkin-Elmer Corporation, Norwalk, Conn.

[21] Appl. No.: 678,869

[22] Filed: Dec. 6, 1984

[51] Int. Cl.[4] ..... C04B 35/48; B05D 1/08

[52] U.S. Cl. ..... 501/105; 501/104; 501/128; 501/133; 501/152; 501/154; 501/134; 428/403; 428/404; 427/423

[58] Field of Search ..... 428/403, 404; 427/423; 501/104, 105, 128, 133, 152, 154, 134

[56] References Cited

U.S. PATENT DOCUMENTS

| | | | |
|---|---|---|---|
| 3,069,292 | 12/1962 | Alexander et al. | 428/404 |
| 3,322,515 | 5/1967 | Dittrich et al. | 501/93 |
| 3,607,343 | 9/1971 | Longo et al. | 501/127 |
| 3,617,358 | 11/1971 | Dittrich | 427/423 OR |
| 3,655,425 | 4/1972 | Longo et al. | 428/403 |
| 3,989,872 | 11/1976 | Ball | 428/403 |
| 3,991,240 | 11/1976 | Harrington et al. | 428/403 |
| 4,374,173 | 2/1983 | Adamovic | 427/423 |
| 4,421,799 | 12/1983 | Novinski | 428/472 |

*Primary Examiner*—William R. Dixon, Jr.
*Assistant Examiner*—Karl Group
*Attorney, Agent, or Firm*—H. S. Ingham; F. L. Masselle; E. T. Grimes

[57] ABSTRACT

A thermal spray powder comprising particles with a central core of a material selected from the group consisting of zirconium oxide, magnesium oxide, hafnium oxide, cerium oxide, yttrium oxide and combinations thereof. The core then has discrete aluminum particles and silicon dioxide homogeneously disposed in a binder deposited thereon to form the thermal spray powder which may be thermal sprayed to produce an abradable and erosion resistant coating.

10 Claims, No Drawings

ALUMINUM AND SILICA CLAD REFRACTORY OXIDE THERMAL SPRAY POWDER

This invention relates to thermal spray powders which will produce refractory oxide coatings characterized by both abradability and erosion resistance and to a process of thermal spraying such coatings.

BACKGROUND OF THE INVENTION

Thermal spraying, also known as flame spraying, involves the heat softening of a heat fusible material, such as a metal or ceramic, and propelling the softened material in particulate form against a surface which is to be coated. The heated particles strike the surface and bond thereto. A conventional thermal spray gun is used for the purpose of both heating and propelling the particles. In one type of thermal spray gun, the heat fusible material is supplied to the gun in powder form. Such powders are typically comprised of small particles, e.g., below 100 mesh U.S. Standard screen size to about 5 microns.

A thermal spray gun normally utilizes a combustion or plasma flame to produce the heat for melting the powder particles. It is recognized by those of skill in the art, however, that other heating means may be used as well, such as electric arcs, resistant heaters or induction heaters, and these may be used alone or in combination with other forms of heaters. In a powder-type combustion flame spray gun, the carrier gas for the powder can be one of the combustion gases, or it can be simply compressed air. In a plasma spray gun, the primary plasma gas is generally nitrogen or argon, and hydrogen or helium is usually added to the primary gas. The carrier gas is generally the same as the primary plasma gas, although other gases, such as hydrocarbons, may be used in certain situations.

The nature of the coating obtained by thermal spraying a metal or ceramic powder can be controlled by proper selection of the composition of the powder, control of the physical nature of the powder and the use of select flame spraying conditions. It is well known and common practice to thermal spray a simple mixture of ceramic powder and metal powder.

In the manufacture of gas turbines, abradable metal compositions have been available for thermal spraying onto the gas turbine parts for the purpose of reducing the clearance between the fan or compression blades and the housing. The blades seat themselves within the housing by abrading the coating.

Thermal sprayed oxides, such as zirconia, have been tried as abradable coatings for the higher temperature sections of turbine engines, but this has been done only with limited success. When such refractory oxides are thermal sprayed with sufficient heat, such as with a plasma spray gun, to provide a suitably bonded and coherent coating, the abradability of the coating is poor. It has also been found that the blade tips of turbines wear excessively. When an oxide is thermal sprayed under conditions of lower heat, many of the particles are not sufficiently melted and are trapped in the coating, thereby reducing the deposit efficiency. The resulting coatings have also been found to be friable and not sufficiently resistant to the erosive conditions of the high velocity gases and debris found in turbine engines.

U.S. Pat. No. 4,421,799 reflects progress toward a solution of these problems. A thermal spray powder is disclosed that is produced by cladding aluminum to a core of a refractory oxide material, specifically zirconium oxide, hafnium oxide, magnesium oxide, cerium oxide, yttrium oxide or combinations thereof. A binder is used, such as a conventional organic binder known in the prior art to be suitable for forming a coating on such a surface. Thermal spray coatings of such a powder are characterized by both abradability and erosion resistance and have been good prospects for use as abradable coatings in high temperature zones of turbine engines. However, further improvements have been deemed highly desirable.

U.S. Pat. No. 3,607,343 broadly discloses thermal spray powders having an oxide core such as alumina or zirconia clad with fluxing ceramic. A large number of fluxing ceramics are suggested that include high silicas. The thrust of the patent is the production of nonporous, wear-resistant coatings.

In view of the foregoing, it is a primary object of the present invention to provide an improved thermal spray powder for producing an abradable coating which is also erosion resistant.

It is a further object of this invention to provide an improved thermal sprayed abradable coating suitable for use in the high temperature portions of a gas turbine engine.

BRIEF DESCRIPTION OF THE INVENTION

The foregoing and other objects of the present invention are achieved by a thermal spray powder for producing a coating which is characterized by being both abradable and erosion resistant. The powder, according to the present invention, has aluminum and silicon dioxide homogeneously bonded to a core made of a refractory oxide material, specifically zirconium oxide, hafnium oxide, magnesium oxide, cerium oxide, yttrium oxide or combinations thereof. Preferably the aluminum is in the form of discrete particles in a binder comprising silicon dioxide derived from ethyl silicate.

DETAILED DESCRIPTION OF THE INVENTION

According to the present invention, a powder has been developed for thermal spraying onto substrates by conventional powder thermal spray equipment. The coating produced by the thermal spraying of the novel powder is both erosion resistant and abradable. The powder itself is made of refractory oxide particles, such as materials based on zirconium oxide, hafnium oxide, magnesium oxide, cerium oxide, yttrium oxide or combinations thereof. The refractory oxide particles are clad with aluminum and silicon dioxide using conventional cladding techniques such as described in U.S. Pat. No. 3,322,515.

Zirconium oxide and hafnium oxide, as used herein for core materials, should be stabilized or partially stabilized forms according to well known art. For example, such oxide may additionally contain a portion of calcium oxide or yttrium oxide which stabilizes the zirconium or hafnium oxide crystal structures to prevent crystal transformation and cracking at high temperature. Magnesium zirconate is especially desirable as a core oxide material and may comprise approximately equal molecular amounts of zirconium oxide and magnesium oxide. The refractory oxide core powder may also contain minor portions of one or more additional oxides, such as titanium dioxide or silicon dioxide.

The core oxide powder, as previously mentioned, may be clad with aluminum in the manner taught in U.S. Pat. No. 3,322,515. In a technique taught in that patent, discrete particles of aluminum are clad to the core particles using a binder, such as the conventional binders known in the prior art suitable for forming a coating on such a surface. The binder may be a varnish containing a resin, such as varnish solids, and may contain a resin which does not depend on solvent evaporation in order to form a dried or set film. The varnish may contain, accordingly, a catalyzed resin. Examples of binders which may be used include the conventional phenolic, epoxy or alkalyd varnishes, varnishes containing drying oils, such as tung oil and linseed oil, rubber and latex binders and the like. The binder is desirably of the water soluble type, such as polyvinylalcohol or preferably polyvinylpyrrolidone.

According to the present invention silicon dioxide is mixed homogeneously with the aluminum to form the cladding. The discrete aluminum particles are quite fine, for example, −10 microns. For good homogeneity the silicon dioxide should be at least in the form of ultra fine particles of less than 1 micron size such as silica fume or collodial silica. The silicon dioxide may be in a molecular form such as sodium silicate.

Preferably ethyl silicate is used to provide the silicon dioxide. Ethyl silicate, as is known in the art and used herein, means tetraethyl orthosilicate having a molecular formula $Si(OCH_2CH_3)_4$. Preferably the ethyl silicate is hydrolized with water to form a gel that dries into a silicon dioxide bonding agent, providing an adherent film and improved bonding of the aluminum particles.

Hydrolizing can be accomplished by known or desired methods. For example, 5 parts by volume (ppv) of ethyl silicate is vigorously mixed with 1 ppv of dilute hydrochloric acid (1% by weight in water) catalyst until the solution becomes clear. Agitation is continued for 15 to 20 minutes while 5 ppv water is added to the mixture. The solution is then hydrolized and must be used within one hour due to poor stability.

Alternatively commercial formulations are available requiring modified procedures. For example Union Carbide's type ESP ethyl silicate is pre-catalyzed and partially hydrolized, and merely requires addition of water.

The hydrolized ethyl silicate may be used as a binder per se for the aluminum particles or may be used in combination with an organic binder, preferably of the water soluble type where a portion of the water used during cladding contributes to the hydrolizing. Upon drying of the finished powder the hydrolized ethyl silicate decomposes to yield silicon dioxide as a derivative of the ethyl silicate.

The finished thermal spray powder should have a particle size generally between about −100 mesh (U.S. standard screen size) (149 microns) and +5 microns and preferably between −200 mesh (74 microns) and +15 microns. The aluminum should be present in an amount between about 0.5% and about 15%, and preferably between about 1% and about 10% based on the total weight of the aluminum and the core. The silicon dioxide content should be between about 0.5% and about 20%, and preferably between about 1% and about 10%. Percentages are by weight based on the total of the aluminum and the refractory oxide core. The powder is thermal sprayed using known or desired techniques, preferably using a combination flame spray gun to obtain coating that is both abradable and erosion resistent.

EXAMPLE

A thermal spray powder according to the present invention was made by mixing 159 grams of finely divided aluminum powder having an average size of about 3.5 to 5.5 microns with 4380 grams of magnesium zirconate particles having a size ranging between −270 mesh U.S. Standard screen size and +10 microns. To this blend was added 850 cc of a solution containing polyvinylpyrrolidone (PVP) binder. The solution consisted of 150 parts by volume (ppv) of 25% PVP solution, 100 ppv of acetic acid and 600 ppv of water. The aluminum and binder formed a mixture having a syrupy consistency. While continuing to blend this mixture, 204 grams of partially hydrolized ethyl silicate, Union Carbide type ESP was added. After all the ingredients were thoroughly blended together, the blend was warmed to about 90° C. The blending was continued until the binder dried, leaving a free-flowing powder in which all of the core particles of magnesium zirconate were clad with a dry film which contained silicon dioxide derivative of ethyl silicate and the aluminum particles. The dry powder was then passed through a 200 mesh screen, U.S. Standard screen size. The final size distribution of the dried powder was approximately 43% between −200 and +325 mesh and 57% less than −325 mesh. The aluminum content was about 3.5% by weight, the organic binder solid content about 0.82% by weight and the silicon dioxide about 1.48% by weight based on the total of the aluminum and magnesium zirconate.

This powder was then thermal sprayed using a standard powder-type combustion spray gun, such as Type 6P sold by METCO Inc., Westbury, New York under the trademark "THERMOSPRAY" gun, using a 6P-7AD nozzle. The spraying was accomplished at a rate of 9 kilograms per hour using a METCO type 3MP powder feeder, using nitrogen carrier gas for the powder, acetylene gas as fuel at a pressure of 0.33 bar, oxygen at 1.07 bar, cooling air at 1.3 bar, a spray distance of 10 cm, a traverse rate of 5 meters per minute and preheat temperature of about 150° C. Using this method, coatings of 125 microns to 4 mm in thickness have been produced on a mild steel substrate prepared with a bond coat typically of flame sprayed aluminum clad nickel alloy powder as described in U.S. Pat. No. 3,322,515. Metallographic examination of the coating produced by the above-described method revealed a highly porous structure containing approximately 40% porosity by volume.

As a basis for comparison coatings were thermal sprayed using the powder of the Example of U.S. Pat. No. 4,421,799, which is similar but contains no silicon dioxide. Spraying conditions were the same except spray distance was 13 cm and spray rate 1.4 kilograms per hours, the difference being to produce coatings having comparable hardness values, viz., R15Y 70–90.

To determine the suitability of the coating materials for use in, for example, gas turbine engines, an erosion test was developed for testing the coating. A substrate with the coating was mounted on a water cooled sample holder and a propane-oxygen burner ring surrounding an abrasive feed nozzle was located to impinge on the sample. A −270 mesh to +15 micron aluminum oxide abrasive was fed through a nozzle having a diameter of 4.9 mm with a compressed air carrier gas at 3 l/sec flow to produce a steady rate of abrasive delivery for 60 seconds. The flame from the burner produced a surface temperature of approximately 1100° C. The results of this test expressed as coating volume loss per quantity of abrasive were $6.3\times10^{-3}$ cc/gm compared with $10.1\times10^{-3}$ cc/gm for the base coating without ethyl silicate, a 38% improvement.

Abradability of the coatings was also tested. This was accomplished by using two nickel alloy turbine blade segments mounted to an electric motor. The substrate having the test coating was positioned to bear against the rotating blade segments as they were turned by the motor at a rate of approximately 21,000 rpm. The coating performance was measured as a ratio of the depth of cut into the coating and loss of length of the blades. The ratio for the example coating of the present invention was 0.80 as compared with 0.48 for the base coating, or 67% better.

Coatings disclosed herein may be used in any application that could take advantage of a coating resistant to high temperature, erosion, or thermal shock or having the properties of porosity or erosion resistance. Examples are bearing seals, compressor shrouds, furnaces, boilers, exhaust ducts and stacks, engine piston domes and cylinder heads, leading edges for aerospace vehicles, rocket thrust chambers and nozzles and turbine burners.

While the invention has been described above in detail with reference to specific embodiments, various changes and modifications which fall within the spirit of the invention and scope of the appended claims will become apparent to those skilled in this art. The invention is therefore only intended to be limited by the appended claims or their equivalents.

What is claimed is:

1. A thermal spray powder characterized by ability to produce an abradable and erosion resistant coating, consisting essentially of particles having a central core of a material selected from the group consisting of zirconium oxide, magnesium oxide, hafnium oxide, cerium oxide, yttrium oxide and combinations thereof, and aluminum and silicon dioxide homogeneously bonded to the surface of said core; the powder particles having a size between about 149 microns and 5 microns; and said aluminum being present in an amount between 0.5% and 15% by weight, and said silicon dioxide being present in an amount between 0.5% and 20% by weight, based on the total of the aluminum and the core material.

2. The thermal spray powder according to claim 1 in which said central core consisting essentially of a material selected from the group consisting of zirconium oxide, magnesium oxide and combinations thereof.

3. A thermal spray powder according to claim 1 in which said aluminum is present in an amount between 1% and 10% by weight and said silicon dioxide is present in an amount between 1% and 10% by weight, based on the total of the aluminum and the core material.

4. A thermal spray powder according to claim 1 in which said aluminum and said silicon dioxide are in the form of discrete particles bonded to the surface of said core with a binder, said aluminum particles having a size below 10 microns and said silicon dioxide particles having a size below 1 micron.

5. The thermal spray powder according to claim 4 in which said binder is an organic binder.

6. A thermal spray powder characterized by ability to produce an abradable and erosion resistant coating, consists essentially of particles having a central core of a material selected from the group consisting of zirconium oxide, magnesium oxide, hafnium oxide, cerium oxide, yttrium oxide and combinations thereof, and discrete particles of aluminum having a size below 10 microns bonded to the surface of said core with a binder comprising a silicon dioxide derivative of ethyl silicate; the powder particles having a size between about 149 microns and 5 microns; and said aluminum being present in an amount between 0.5% and 15% by weight, and said silicon dioxide being present in an amount between 0.5% and 20% by weight, based on the total of the aluminum and the core material.

7. The thermal spray powder according to claim 6 in which said binder further is an organic binder of the water soluble type.

8. The thermal spray powder according to claim 6 in which said central core consists essentially of a material selected from the group consisting of zirconium oxide, magnesium oxide and combinations thereof.

9. A thermal spray powder according to claim 6 in which said aluminum is present in the amount between 1% and 10% by weight and said silicon dioxide constant is between about 1% and 10% by weight based on the total of the aluminum and the core material.

10. A thermal spray powder characterized by ability to produce an abradable and erosion resistant coating, consisting essentially of particles having a magnesium zirconate core coated with a binder containing discrete particles of aluminum having a size below 10 microns, in which said spray powder particles have a size between about 149 microns and 5 microns, and said binder consisting essentially of organic binder of the water soluble type and a silicon dioxide derivative of ethyl silicate; said aluminum being present in an amount between 1% and 10% by weight based on the total of the aluminum and core, and said silicon dioxide being present in an amount between 1% and 10% by weight, based on the total of the aluminum and core.

* * * * *